US012366023B2

(12) United States Patent
Jang et al.

(10) Patent No.: US 12,366,023 B2
(45) Date of Patent: Jul. 22, 2025

(54) ANHYDROUS DYEING SYSTEM FOR YARN

(71) Applicant: ASSEMS INC., Busan (KR)

(72) Inventors: Ji-Sang Jang, Busan (KR); Jae-Jeong Lee, Busan (KR); Kyoung-Kyu Kim, Busan (KR); Kyung-Seok Choi, Busan (KR); Chi-Kyun Park, Busan (KR); Yong-Hoon Park, Gimhae-si (KR)

(73) Assignee: ASSEMS INC., Busan (KR)

( * ) Notice: Subject to any disclaimer, the term of this patent is extended or adjusted under 35 U.S.C. 154(b) by 272 days.

(21) Appl. No.: 18/028,426

(22) PCT Filed: Aug. 26, 2021

(86) PCT No.: PCT/KR2021/011429
§ 371 (c)(1),
(2) Date: Mar. 24, 2023

(87) PCT Pub. No.: WO2022/075589
PCT Pub. Date: Apr. 14, 2022

(65) Prior Publication Data

US 2023/0332343 A1 Oct. 19, 2023

(30) Foreign Application Priority Data

Oct. 7, 2020 (KR) ..... 10-2020-0129450

(51) Int. Cl.
*D06B 3/04* (2006.01)
*D06B 11/00* (2006.01)
(Continued)

(52) U.S. Cl.
CPC ..... *D06B 3/04* (2013.01); *D06B 11/0009* (2013.01); *D06B 11/0076* (2013.01);
(Continued)

(58) Field of Classification Search
CPC ..... D06B 3/04; D06B 23/025; D06B 23/22; D06B 2700/02; D06B 2700/35;
(Continued)

(56) References Cited

U.S. PATENT DOCUMENTS 3,994,250 A 11/1976 Norris
4,056,352 A 11/1977 Mayer
(Continued)

FOREIGN PATENT DOCUMENTS

CN 205989566 U * 3/2017 ..... B41J 2/01
CN 208517663 U * 2/2019
(Continued)

OTHER PUBLICATIONS

CN205989566 translation (Year: 2017).*
(Continued)

*Primary Examiner* — Michael E Barr
*Assistant Examiner* — Lauren G Orta
(74) *Attorney, Agent, or Firm* — Paratus Law Group, PLLC

(57) ABSTRACT

There is provided an anhydrous dyeing system for yarn, including: a transfer printer which repeatedly sprays dye ink on a surface of a transfer sheet a plurality of times to laminate and apply ink layers; a dyeing jig which is in a drum form having a plurality of microholes formed in an outer circumferential surface thereof to penetrate inside and outside; a process chamber into which the dyeing jig is put; a heating member for heating the yarn wound on the dyeing jig, by supplying heat to the inside of the process chamber; and a vacuum-generating member which is in communication with an internal space of the dyeing jig and vacuum-evacuates the air in the internal space of the dyeing jig to thereby form a vacuum pressure inside the dyeing jig.

8 Claims, 9 Drawing Sheets

(51) Int. Cl.

| | |
|---|---|
| ***D06B 19/00*** | (2006.01) |
| ***D06B 23/00*** | (2006.01) |
| ***D06B 23/02*** | (2006.01) |
| ***D06B 23/22*** | (2006.01) |
| ***D06P 5/24*** | (2006.01) |
| ***D06P 5/28*** | (2006.01) |

(52) U.S. Cl.
CPC ..... *D06B 19/0058* (2013.01); *D06B 23/00* (2013.01); *D06B 23/025* (2013.01); *D06B 23/22* (2013.01); *D06P 5/003* (2013.01); *D06P 5/006* (2013.01); *D06B 2700/02* (2013.01); *D06B 2700/35* (2013.01)

(58) Field of Classification Search
CPC ..... D06B 11/0009; D06B 19/0058; D06B 11/0076; D06B 23/00; D06P 5/006; D06P 5/003
See application file for complete search history.

(56) References Cited

U.S. PATENT DOCUMENTS

2008/0040870 A1* 2/2008 Ronchi ..... D06B 19/0076 8/151.2
2015/0306865 A1 10/2015 Ozaki

FOREIGN PATENT DOCUMENTS

| | | | | | |
|---|---|---|---|---|---|
| DE | 4008755 | A1 | | 9/1991 | |
| EP | 0561367 | A2 | | 9/1993 | |
| JP | H09-073178 | A | | 3/1997 | |
| JP | 2001-329474 | A | | 11/2001 | |
| JP | 2016108697 | A | * | 6/2016 | ..... B41J 2/01 |
| JP | 2019147298 | A | * | 9/2019 | ..... B41J 11/46 |
| KR | 20-0334356 | Y1 | | 11/2003 | |
| WO | WO 2014/084104 | A1 | | 6/2014 | |

OTHER PUBLICATIONS

CN208517663 translation (Year: 2019).*
JP2016108697 translation (Year: 2016).*
JP2019147298 translation (Year: 2019).*
International Search Report for PCT/KR2021/011429 mailed Dec. 10, 2021 from Korean Intellectual Property Office.
Chinese Office Action for related CN Application No. 202180065850.8 mailed Oct. 11, 2024 from China National Intellectual Property Administration.
European Search Report for related EP Application No. 21877841.3 mailed Oct. 16, 2024 from European Patent Office.

* cited by examiner

ANHYDROUS DYEING SYSTEM FOR YARN

CROSS-REFERENCE TO PRIOR APPLICATIONS

This application is a National Stage Patent Application of PCT International Patent Application No. PCT/KR2021/011429 (filed on Aug. 26, 2021) under 35 U.S.C. § 371, which claims priority to Korean Patent Application No. 10-2020-0129450 (filed on Oct. 7, 2020), which are all hereby incorporated by reference in their entirety.

BACKGROUND

The present disclosure relates to a system for dyeing yarn using vacuum transfer, and more particularly, to an anhydrous dyeing system for yarn capable of anhydrous dyeing by winding yarn to be dyed around an outer circumferential surface of a jig which is in a porous drum form, covering a transfer sheet on which dye ink is applied on an outer surface thereof, and then generating a vacuum pressure through an internal space of a dyeing jig in a high-temperature chamber so as to transfer dye ink to the yarn.

In general, in order to express various patterns or colors on fabric, a method of manufacturing fabric using different colored threads for warp and weft has been used. In the method of manufacturing fabric, as a pattern or color of the fabric is standardized, the pattern or color may not be variously changed. In order to obtain a unique image of a pattern or color, there is a problem in that a lot of production cost increases because it goes through several stages of a preparation process.

In addition, there is a problem in that, in order to partially dye a fiber, since a plurality of dyeing tanks are required and the fiber should go through several stages of a winding process, many devices are required and their installation costs cause an increase in production cost, and several winding processes are not only very cumbersome, but also dyeing in irregular shapes does not work well.

In order to solve this issue, Korea Utility Model Registration No. 20-0334356 discloses a multicolor dyeing apparatus capable of providing a fiber with various colors by spraying pigment to an outer diameter portion of the fiber wound around a bobbin, and vacuum-suctioning the pigment so that the sprayed pigment may be uniformly absorbed up to an inner diameter portion of the fiber.

However, since the conventional yarn dyeing apparatus including the registered utility model uses a method of spraying or dipping a liquid mixed with dye, a large amount of pollutants and a lot of wastewater are generated during a dyeing process, and therefore, it takes a lot of time and money to purify pollutants, which lowers economic efficiency, and but also it is difficult to completely purify the pollutants, which adversely affects the environment.

SUMMARY

The present disclosure is directed to addressing an issue associated with the related art, and to providing an anhydrous dyeing system for yarn capable of performing an environmentally friendly anhydrous dyeing process without using water by laminating and printing dye ink on a surface of a transfer sheet a plurality of times to apply ink layers, and then dry the same in a short time to manufacture the transfer sheet, installing the manufactured transfer sheet in an outer side surface of the yarn wound on an outer circumferential surface of a dyeing jig, and generating a vacuum pressure through an internal space of the dyeing jig in a high-temperature chamber so as to transfer the dye ink applied on the transfer sheet to the yarn and perform dyeing.

The anhydrous dyeing system for yarn according to an embodiment of the present disclosure includes: a transfer printer which repeatedly sprays dye ink on a surface of a transfer sheet a plurality of times to laminate and apply ink layers; a dyeing jig which is in a drum form having a plurality of microholes formed in an outer circumferential surface thereof to penetrate inside and outside, wherein the yarn to be dyed and the transfer sheet on which the ink layers are applied are sequentially wound on the outer circumferential surface thereof; a process chamber into which the dyeing jig is put; a heating member for heating the yarn wound on the dyeing jig, by supplying heat to the inside of the process chamber; and a vacuum-generating member which is in communication with an internal space of the dyeing jig and vacuum-evacuates the air in the internal space of the dyeing jig to thereby form a vacuum pressure inside the dyeing jig.

An embodiment of the present disclosure enables, to be performed quickly and efficiently, a series of processes of spraying dye ink on a surface of a transfer sheet in a transfer printer to form ink layers in a predetermined pattern to manufacture the transfer sheet, installing the manufactured transfer sheet by winding the same on an outer surface of the yarn wound on an outer circumferential surface of a dyeing jig, and then heating the yarn in the process chamber and forming the vacuum pressure in the dyeing jig to dye the dye ink of the transfer sheet on the yarn by a vacuum transfer method.

In particular, after ink layers are repeatedly printed and laminated on the transfer sheet in the transfer printer a plurality of times, inorganic fine powder is supplied to the ink layers in a fine powder applicator so that the ink layers can be quickly dried, thereby preventing defects in the transfer sheet due to smearing of the ink layers after application of the ink layers.

In addition, since the transfer printer can accurately return the transfer sheet to its initial position using a position detection unit and repeatedly laminate and apply the ink layers, a sufficient amount of dye ink required for anhydrous dyeing of yarn can be quickly and easily applied to the transfer sheet in an accurate pattern.

In a vacuum transfer device, yarn is wound on a cylindrical dyeing jig, and a vacuum pressure is formed inside the dyeing jig, so that the dye ink applied to the transfer sheet is transferred to the yarn and dyed. Hence, it is possible to very quickly and easily perform a dyeing process without using liquid. Furthermore, there is no need to purify the liquid for dyeing, thereby improving economic feasibility and eco-friendliness.

In addition, when a porous drum of the dyeing jig is configured by laminating a plurality of mesh plates in which microholes are formed, the vacuum pressure is uniformly formed over the entire surface of the porous drum to dye the yarn so that the yarn can be dyed in a desired pattern.

DETAILED DESCRIPTION

Hereinafter, various embodiments of an anhydrous dyeing system for yarn according to an embodiment of the present disclosure will be described in detail with reference to the accompanying drawings.

FIGS. 1 to 12 show the anhydrous dyeing system for yarn according to an embodiment of the present disclosure.

Figure 1:
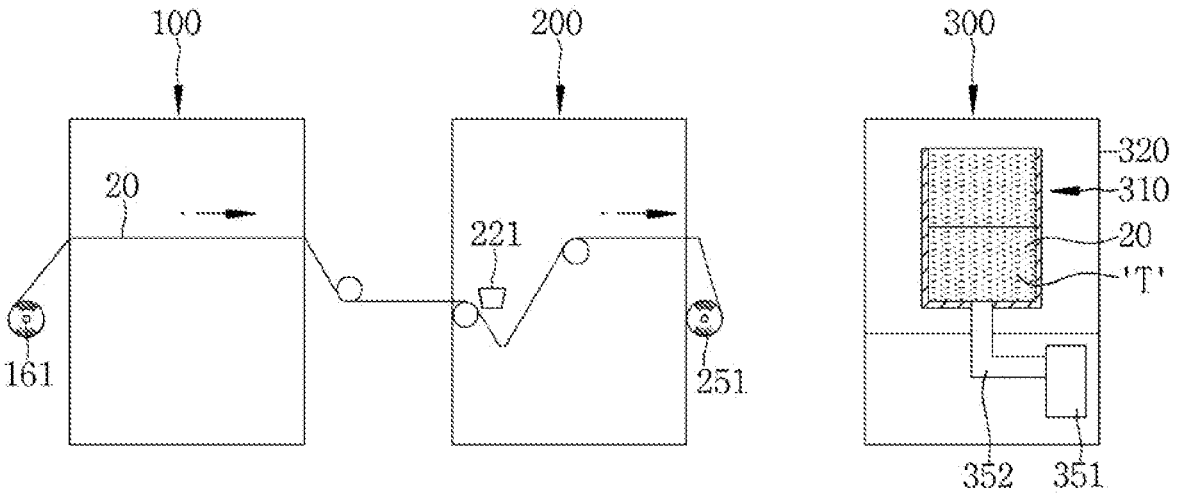
FIG. 1 is a configuration diagram schematically illustrating the entire configuration of an anhydrous dyeing system for yarn according to an embodiment of the present disclosure.

First, referring to FIG. 1, the anhydrous dyeing system for yarn includes: a transfer printer 100 which repeatedly sprays dye ink on a surface of a transfer sheet 20 a plurality of times to laminate and apply ink layers 22; a fine powder applicator 200 which applies and dries inorganic fine powder 23 to the ink layers 22 of the transfer sheet 20 while transporting the transfer sheet 20 on which the ink layers 22 are applied in one direction and passing through the transfer printer 100; and a vacuum transfer device 300 which performs anhydrous dyeing by transferring the dye ink of the ink layers 22 of the transfer sheet 20 to yarn T by applying heat to a dyeing jig 310 around which the yarn T and transfer sheet 20 are wound and simultaneously generating a vacuum pressure inside the dyeing jig 310.

The vacuum transfer device 300 includes: the dyeing jig 310 having a plurality of microholes formed to penetrate inside and outside, wherein the yarn T to be dyed and the transfer sheet 20 are wound on an outer circumferential surface; a process chamber 320 into which dyeing jig 310 is put; a heating member for heating the yarn T wound on the dyeing jig 310 by supplying heat to an inside of the process chamber 320; a vacuum-generating member for forming a vacuum pressure inside the dyeing jig 310 by sucking air through an internal space of the dyeing jig 310; and a preheating member 360 installed to contact a surface of the dyeing jig 310 to deliver heat to the yarn through the surface of the dyeing jig.

Figure 2:
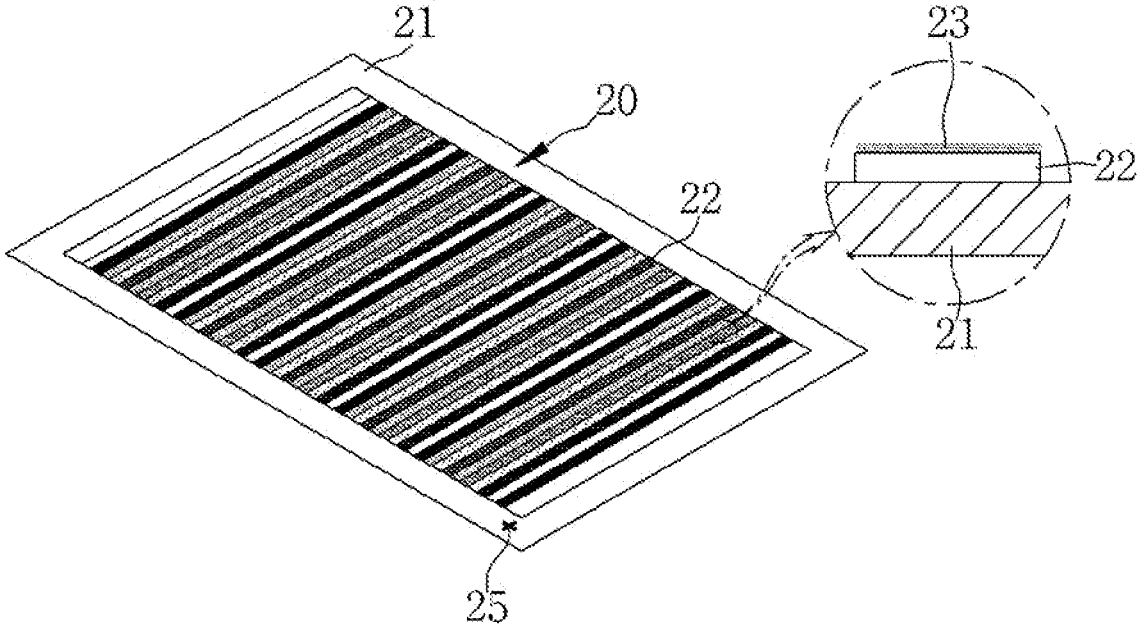
FIG. 2 is a diagram illustrating an example of a transfer sheet manufactured by the anhydrous dyeing system for yarn of an embodiment of the present disclosure.
Figure 3:
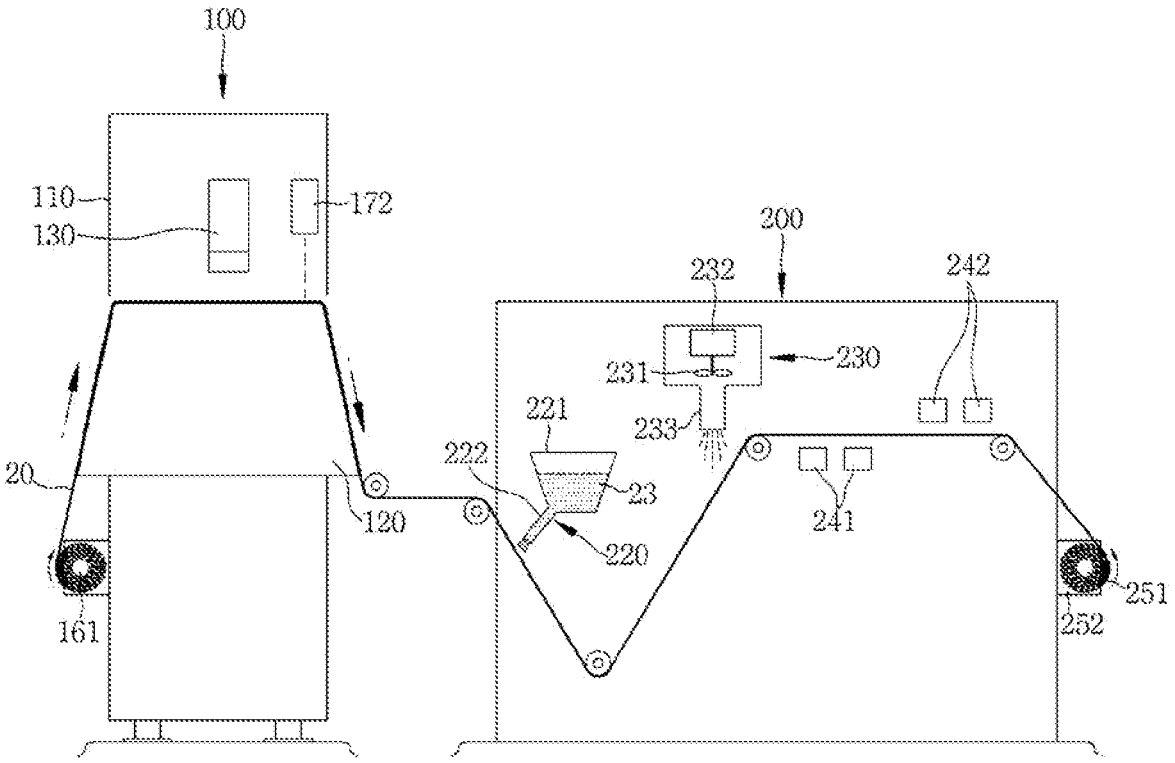
FIG. 3 is a cross-sectional view of the configuration of a transfer printer and a fine powder applicator of an anhydrous dyeing system according to an embodiment of the present disclosure.
Figure 4:
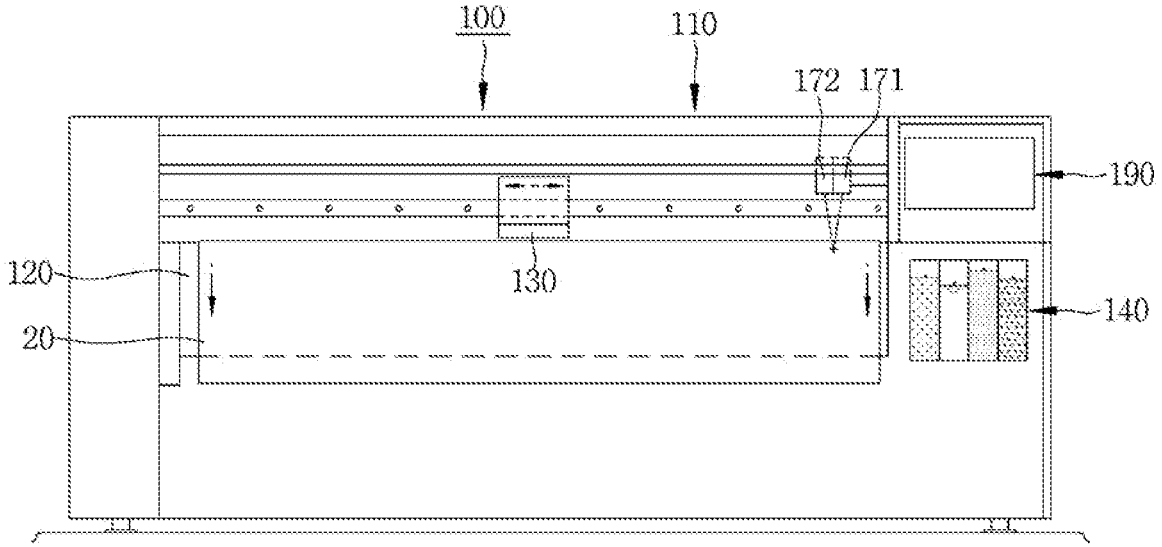
FIG. 4 is a front view of the transfer printer illustrated in FIG. 3.
Figure 5:
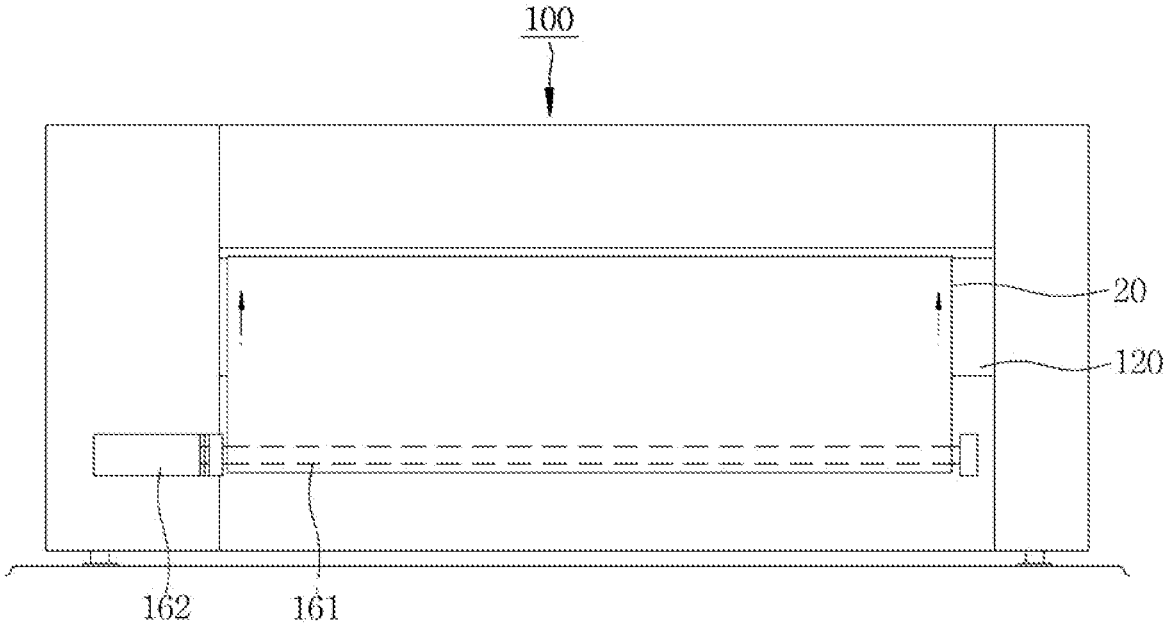
FIG. 5 is a rear view of the transfer printer illustrated in FIG. 3.
Figure 6:
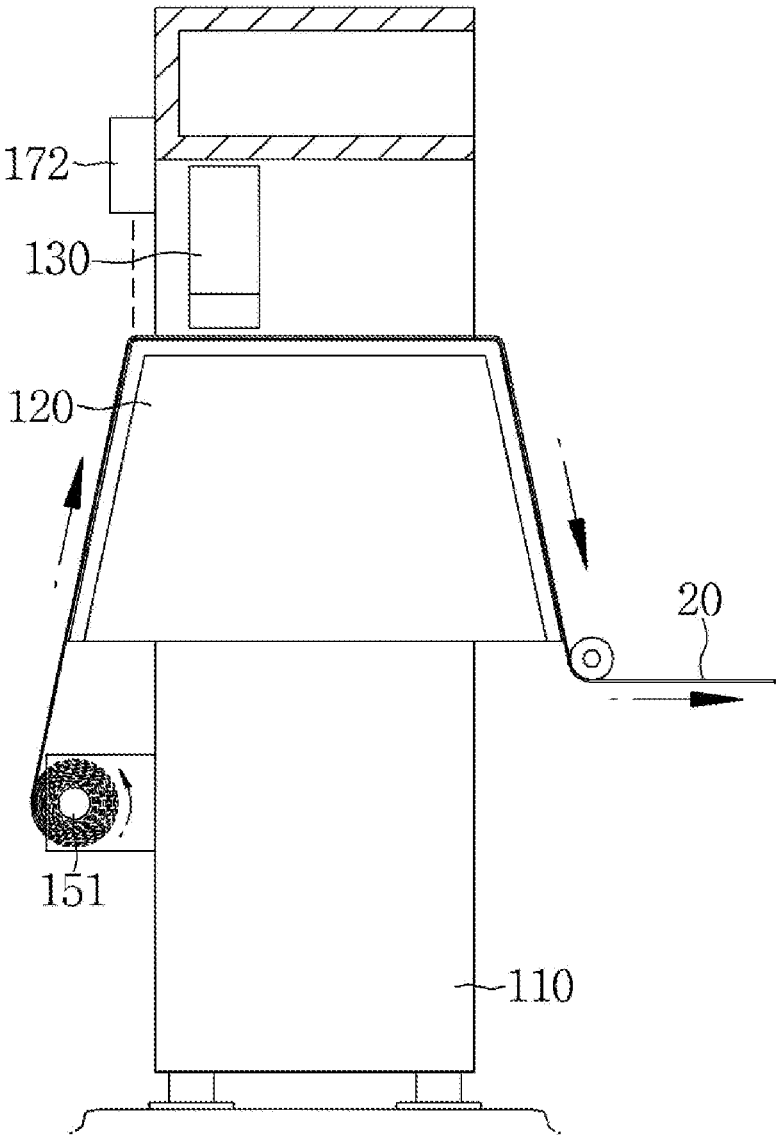
FIG. 6 is a cross-sectional side view of the transfer printer illustrated in FIG. 3.
Figure 7:
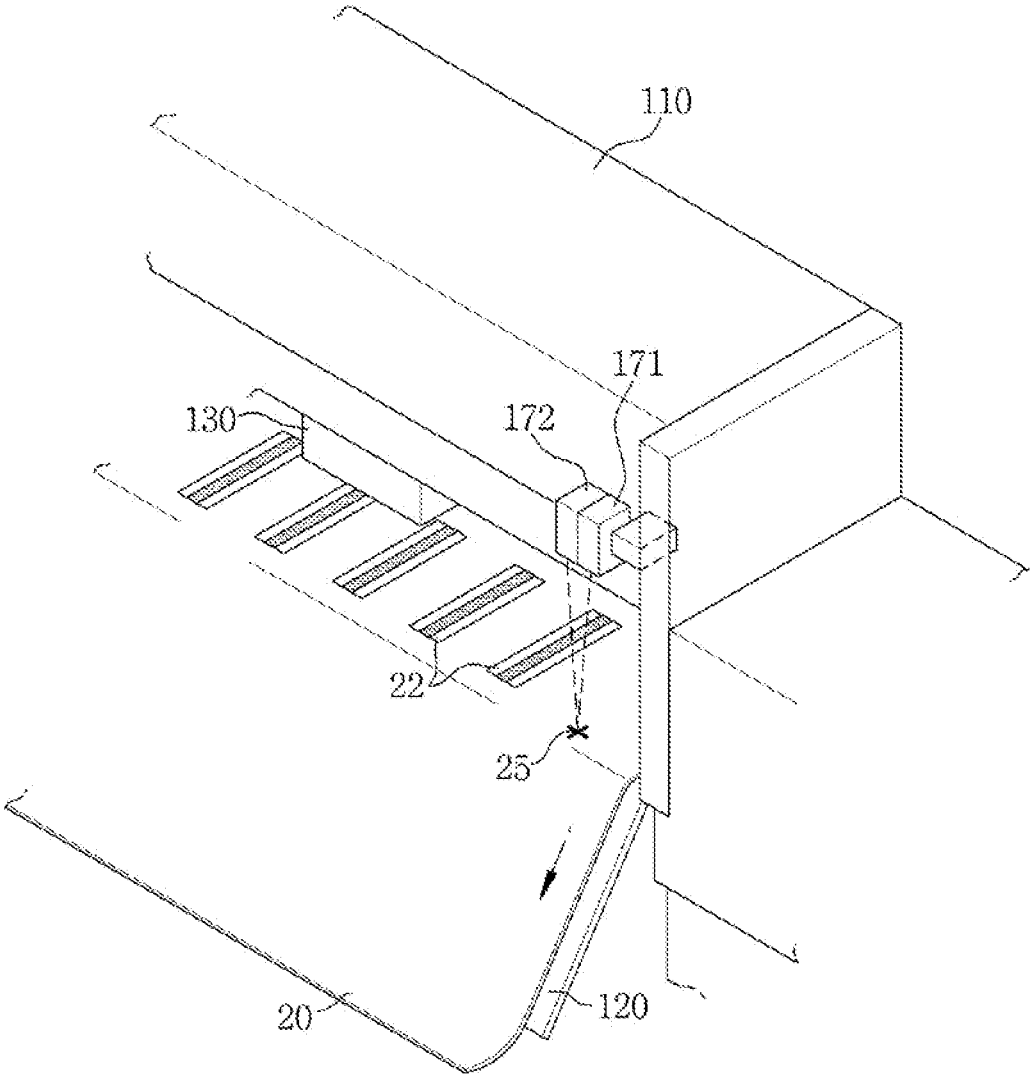
FIG. 7 is a perspective view of a configuration for detecting the transfer sheet position of the transfer printer illustrated in FIG. 3.

As illustrated in FIG. 2, the transfer sheet 20 is intended to cover an outside of the yarn T wound on an outer surface of the dyeing jig 310 on which the vacuum pressure is formed, and the ink layers 22 applied with water-soluble dye ink to be transferred to the yarn in a predetermined pattern is formed on an inner side surface in contact with the yarn. The transfer sheet 20 includes a rectangular sheet body 21 made of a resin material such as paper or PET, which is wound on an outer surface of the yarn wound on the dyeing jig 310, the ink layers 22 formed by printing dye ink on a surface of the sheet body 21 in contact with the yarn, and hygroscopic inorganic fine powder 23 applied to the ink layers 22.

The ink layers 22 are formed by applying a water-soluble dye ink on a surface of the sheet body 21 in a predetermined pattern, and are laminated by repeatedly printing the dye ink a plurality of times using the transfer printer 100. When the ink layers 22 are formed by applying the dye ink only once, the yarn may not be dyed in a desired color because the amount of the dye ink that is vacuum-transferred during an anhydrous dyeing process is not sufficient. Accordingly, the ink layers 22 are thickly formed by repeatedly spraying the dye ink a plurality of times. In this connection, the dye ink contains a volatile preservative to prevent hardening during storage. When the ink layers 22 are repeatedly applied several times, the preservative does not volatilize and remains, and the ink layers 22 becomes a viscous gel state.

Accordingly, the ink layers 22 may be quickly dried by applying the ink layers 22 by repeatedly printing the same a plurality of times, and then applying the hygroscopic inorganic fine powder 23 thereon, and heating and drying the same. For example, when the ink layers 22 are repeatedly applied 10 times, the inorganic fine powder 23 is applied after the first 4 times the ink layers 22 are applied, and the ink layers 22 are applied thereon 3 or 4 times. Thereafter, after the inorganic fine powder 23 is applied again, the ink layers 22 are again applied thereon 2 to 3 times, and then the inorganic fine powder 23 is applied. After the application of the ink layers 22 is completed, the inorganic fine powder 23 may be applied only once thereon.

FIGS. 3 to 7 show the configuration of the transfer printer 100 and the fine powder applicator 200 for manufacturing the transfer sheet 20 on which the ink layers 22 and the inorganic fine powder 23 are applied on a surface of the transfer sheet 20 as described above, wherein the fine powder applicator 200 is disposed in a row on one side of the transfer printer 100 to receive the transfer sheet and perform a process of applying the inorganic fine powder 23. On one side of the fine powder applicator 200, a sheet transport unit for continuously transporting the transfer sheet 20 from the transfer printer 100 to the fine powder applicator 200 is installed. The operation of the transfer printer 100, the fine powder applicator 200, and the sheet transport unit is controlled by a controller 190.

Referring to FIGS. 3 to 7, the transfer printer 100 includes: a printer body 110; a loading shaft 161 rotatably installed at a rear of the printer body 110 to wind the transfer sheet 20 to be printed; a sheet guide 120 guided while the transfer sheet 20, which is released from the loading shaft 161 by the sheet transport unit and transported, passes; a nozzle head 130 installed on an upper side of the sheet guide 120 to be reciprocally movable in a lateral direction and spraying the dye ink in a predetermined pattern on a printed surface of the transfer sheet 20 to apply the ink layers 22; an ink supply portion 140 for supplying the dye ink to the nozzle head 130; a return drive portion 162 which moves the transfer sheet 20 backward by rotating the loading shaft 161 in a reverse direction; and a position detection unit which detects a position of the transfer sheet 20 when the transfer sheet moves backward and returns by the return drive portion 162.

The printer body 110 is composed of a frame and a plate to install various components and electric parts configuring a printing device, and is stably installed on a floor surface.

The loading shaft 161 is horizontally installed at a rear of the printer body 110 to wind the transfer sheet 20 to be printed. The loading shaft 161 is rotatably installed in the printer body 110, and one end is connected to the return drive portion 162 to receive power from the return drive portion 162 and rotate.

The return drive portion 162 includes a servomotor directly connected to one end of the loading shaft 161 or connected to one end of the loading shaft 161 through a power transmission mechanism such as a belt or gear, and receives a control signal from the controller 190 and operates.

The nozzle head 130 horizontally reciprocates on an upper portion in a lateral direction of the sheet guide 120 by a known linear motion device, while applying the ink layers 22 to a printed surface of the transfer sheet 20 by spraying the dye ink supplied from the ink supply portion 140 in a pattern input in advance to the controller 190. The linear motion device for moving the nozzle head 130 and the ink supply portion 140 for supplying dye ink to the nozzle head 130 may be configured by applying the linear motion device and an ink supply device configured in a known sublimation transfer inkjet printer.

The sheet guide 120 is fixed to an upper portion of the printer body 110, and the front and rear portions thereof are inclined so that the transfer sheet 20 may be stably transported forward and backward while supporting the same, and the upper portion thereof may be formed in a flat plate form.

While the transfer sheet 20 is repeatedly moved forward and backward several times in the transfer printer 100, the ink layers 22 are repeatedly printed in the same pattern and laminated. As such, when the transfer sheet 20 moves forward and returns to the original position after the ink layers 22 are applied, the ink layers 22 may be accurately printed in the same pattern only when it is accurately returned to the initial position. Accordingly, when the transfer sheet 20 moves backward and returns, the position detection unit detects the position of an indexing mark displayed on the transfer sheet 20 so that the transfer sheet 20 may accurately return to the initial position.

The position detection unit may include a mark generator 171 installed on an upper part of the printer body 110 to generate the indexing mark 25 on the printed surface of the transfer sheet immediately before starting a print job, and a mark sensor 172 installed on one side of the mark generator 171 to sense the indexing mark 25.

The mark generator 171 may emit a laser beam to a point on the printed surface of the transfer sheet 20 to generate the indexing mark 25 on the printed surface of the transfer sheet 20 by perforating or displaying the same. The mark generator 171 may otherwise be configured by applying a dispensing device that displays the indexing mark 25 by discharging ink having a predetermined color on the printed surface of the transfer sheet 20.

The mark sensor 172 is installed to be electrically connected to the controller 190 on one side of the mark generator 171, and senses the indexing mark 25 generated by the mark generator 171 and sends the sensed signal to the controller 190. The mark sensor 172 may be configured by applying a sensor such as a known photoelectric sensor for sensing contrast or color, or a camera or image sensor for sensing a mark by capturing an image.

Referring back to FIG. 3, the fine powder applicator 200 applies the hygroscopic inorganic fine powder 23 such as silicon dioxide ($SiO_2$) fine powder, starch fine powder, $TiO_2$ fine powder, and talc fine powder to the ink layers 22 having viscosity, which is applied while being laminated on the transfer sheet 20 in a certain pattern, and then heat-dried.

Specifically, the fine powder applicator 200 includes: an applicator body 210 disposed in a row in front of the transfer printer 100; a fine powder supply unit 220 disposed on an upper side of a transport path of the transfer sheet 20 inside the applicator body 210 and spraying the inorganic fine powder 23 to a lower side; a fine powder removal unit 230 disposed on a front side of the fine powder supply unit 220 and spraying air toward the transfer sheet 20 to separate and remove the inorganic fine powder 23 smeared on an outside of the ink layers from a surface of the transfer sheet 20; and a heating and drying unit installed on a front side of the fine powder removal unit 230 and applying heat toward the transfer sheet 20.

The applicator body 210 may be configured as a separate body with the printer body 110 of the transfer printer 100, but may otherwise be configured integrally with the printer body 110.

The fine powder supply unit 220 includes a fine powder storage container 221 for storing the inorganic fine powder 23 and a fine powder nozzle 222 for supplying the inorganic fine powder 23 in the fine powder storage container 221 to the transfer sheet 20 on a lower side.

The fine powder removal unit 230 sprays compressed air toward the transfer sheet 20 onto which the inorganic fine powder 23 is sprayed to remove the inorganic fine powder 23 smeared on the part other than the ink layers 22 of the transfer sheet 20. After the inorganic fine powder 23 removed from the transfer sheet 20 falls to a lower side, it may be applied to the ink layers 22 of the transfer sheet 20 again by a guide roll 225 guiding a transport direction of the transfer sheet 20. In this embodiment, the fine powder removal unit 230 includes a blowing fan 231 which blows air by being rotated by a motor 232, and an air nozzle 233 which guides the air blown by the blowing fan 231 to the transfer sheet 20.

The heating and drying unit includes a lower heater 241 disposed on a lower side of the transport path of the transfer sheet to apply heat to the transfer sheet 20, and an upper heater 242 disposed on a front side of the lower heater 241 and disposed on an upper side of the transport path of the transfer sheet 20 to apply heat to the transfer sheet 20. As such, when a heater of the heating and drying unit is configured of a lower heater 241 which applies heat first on an opposite side of the printed surface of the transfer sheet 20, that is, a lower side of the transfer sheet 20, and an upper heater 242 which applies heat later on an upper side, it was identified that after preheating a lower side of the ink layers 22 of the transfer sheet 20, the drying efficiency could be improved by heating the ink layers 22 and the portion applied with the inorganic fine powder 23 to uniformly apply heat throughout.

The lower heater 241 and the upper heater 242 may be configured by applying an infrared heater, but may be configured by applying various other known heaters.

The sheet transport unit is designed to transport the transfer sheet 20 released from the loading shaft 161 of the transfer printer 100 forward at a predetermined pitch, and includes a sheet transport shaft 251 rotatably installed in front of the applicator body 210 and on which the transfer sheet 20 is wound, and a sheet transport motor 252 connected to one end of the sheet transport shaft 251 to rotate the sheet transport shaft 251 by a predetermined amount. Accordingly, when the sheet transport shaft 251 is rotated in one direction by the sheet transport motor 252, the transfer sheet 20 advances by a predetermined pitch.

FIGS. 8 to 12 show the configuration of the vacuum transfer device 300 which performs anhydrous dyeing by transferring the dye ink to the yarn T wound on the dyeing jig 310 using the transfer sheet 20 made by the aforementioned transfer printer 100 and the fine powder applicator 200. The vacuum transfer device 300 includes: the dyeing jig 310; the process chamber 320; the heating member for heating the yarn T wound on the dyeing jig 310 inside the process chamber 320; the vacuum-generating member for forming a vacuum pressure in an internal space of the dyeing jig 310; and the preheating member 360 for delivering heat to the yarn of the dyeing jig 310 immediately before heating the yarn by the heating member.

The yarn T wound on the dyeing jig 310 may be white in an undyed state, but in addition, the yarn T of various colors may be used depending on cases. When the yarn T is wound on an outer surface of the dyeing jig 310, it may be continuously wound in a substantially straight line. However, when the amount of winding of the yarn T increases or the thickness of the yarn itself becomes thick, it may be difficult to form a vacuum pressure. Hence, it is preferable that fine gaps be formed between the yarns T by being wound while crossing each other in a zigzag shape. The yarn T may be wound on an outer surface of the dyeing jig 310 in a separate winder.

The transfer sheet 20 covers the entire outer side of the yarn T wound on the dyeing jig 310. However, in the case where the edges of both sides of the transfer sheet 20 and the edges of both sides of the dyeing jig 310 are not sealed, when air is sucked in by the vacuum-generating member, outside air is introduced through microholes between the edges of both sides of the transfer sheet 20 and the edges of both sides of the dyeing jig 310, and a vacuum pressure may not be properly formed in an internal space of the dyeing jig 310. Accordingly, the ends of both sides of the transfer sheet 20 or the entirety of the transfer sheet 20 are covered with a sealing sheet 330 made of a resin such as silicone, PVF, or PE to seal against the dyeing jig 310.

The dyeing jig 310 is for installing the yarn T and the transfer sheet 20 inside the process chamber 320 and forming a vacuum pressure therein to perform an anhydrous dyeing process through vacuum transfer. In this embodiment, the dyeing jig 310 includes: a porous drum 311 which is in a cylindrical shape and having the yarn T and the transfer sheet 20 wound on an outer circumferential surface; a first drum cover 312 which closes an opening on one side of the porous drum 311; a second drum cover 313 which closes an opening on the other side of the porous drum 311 and is connected to the vacuum-generating member; a hollow shaft 315 installed in communication with a connection hole 313*a* formed in the center of the second drum cover 313 in an internal space of the porous drum 311; and a plurality of support bars 317 installed to extend in an axial direction inside the porous drum 311 and having both ends connected to the first drum cover 312 and the second drum cover 313.

Figure 11:
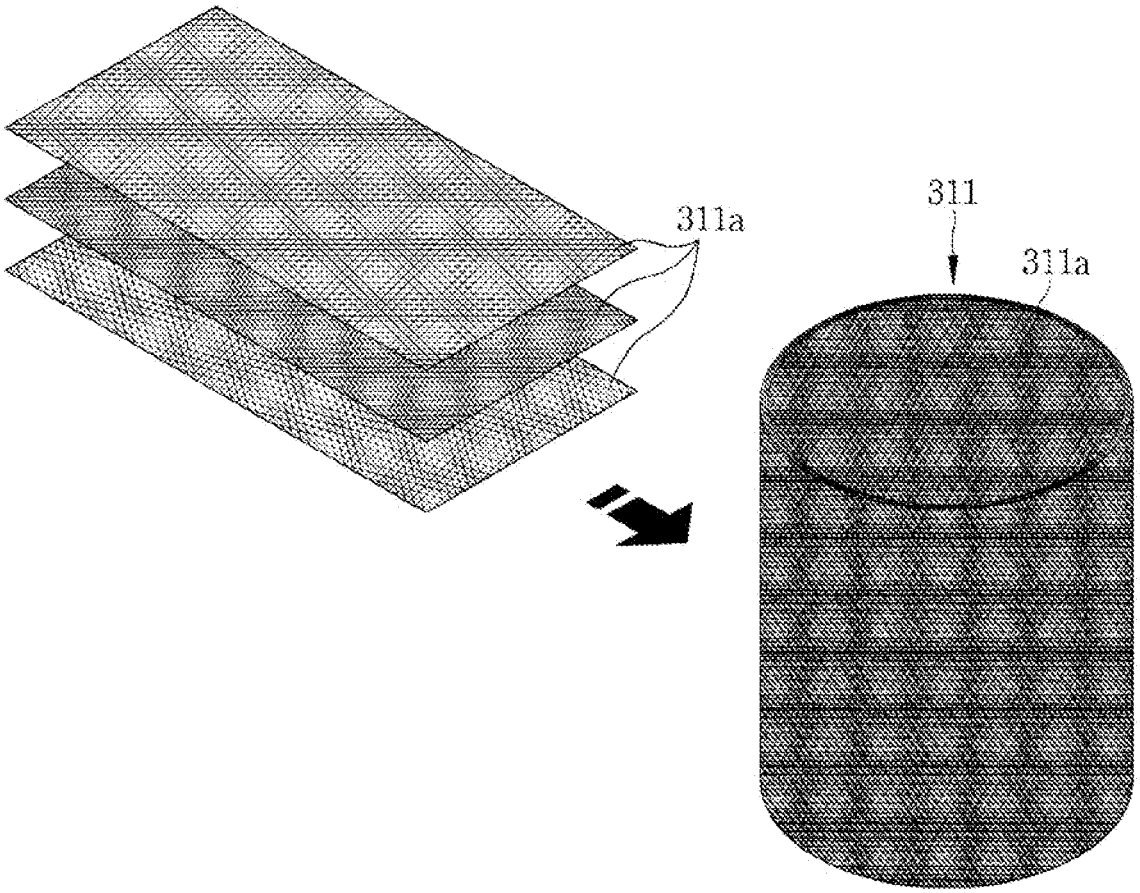
FIG. 11 is a diagram illustrating an embodiment of a porous drum configuring the vacuum transfer device illustrated in FIG. 8.
Figure 12:
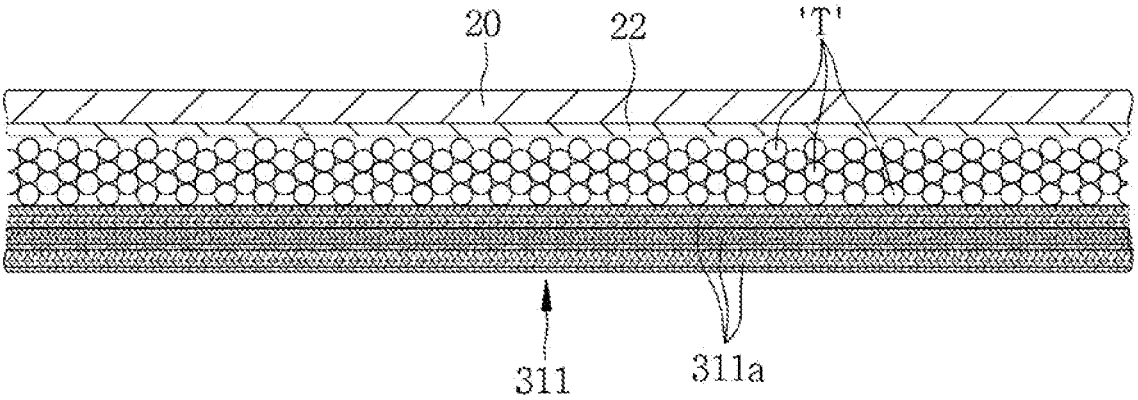
FIG. 12 is an enlarged cross-sectional view of part A of FIG. 10.

The porous drum 311 is a cylindrical drum in which microholes are formed, and the yarn T to be dyed and the transfer sheet 20 are sequentially wound on its outer circumferential surface. The porous drum 311 may be made of a heat-resistant metal plate in which a plurality of microholes are formed at closely spaced intervals. However, as illustrated in FIGS. 11 and 12, in order to improve the dyeing quality, it is preferable to use a thin mesh plate 311*a* formed by laminating and bonding a plurality thereof having micro-scale or millimeter-scale microholes and rolling the same into a cylindrical shape. When the porous drum 311 is manufactured by laminating a plurality of mesh plates 311*a* made of thin metal as such, very fine pores are uniformly distributed over the entire surface of the porous drum 311, so that the dye ink applied to the transfer sheet 20 may be uniformly transferred to the yarn T as a whole, and thus the yarn T may be accurately dyed in a desired pattern.

The plurality of mesh plates 311*a* may laminate and use the plates all having the same microhole size. However, the porous drum 311 may be manufactured by laminating plates having different microhole sizes. In this connection, as illustrated in FIG. 12, it was identified that a better dyeing effect could be obtained when the innermost and outermost mesh plates 311*a* based on a radial direction of the porous drum 311 had a larger size of microholes than the mesh plate 311*a* laminated in the middle. This is because that the suction force may be smoothly delivered to the dye ink applied to an inner surface of the transfer sheet 20 through the outermost mesh plate 311*a* and the innermost mesh plate 311*a* in contact with the yarn T, and that the suction force may be uniformly provided over the entire area through the mesh plate 311*a* of the middle layer.

As described above, the porous drum 311 in which the plurality of mesh plates 311*a* are laminated may be made by welding and joining the plurality of mesh plates 311*a* in a laminated state by applying an electric current, and then rolling the same into a cylindrical shape. In other words, after laminating the plurality of mesh plates 311*a*, a constant pressure is applied for adhesion and direct current is applied to electrodes connected to the mesh plate 311*a* pressured and adhered. After the intersections of the plurality of mesh plates 311*a* are integrated with each other or one another by being welded by heat generation due to resistance, the porous drum 311 may be made in a way to roll the same into a cylindrical shape and manufacture the same in a drum form.

The first drum cover 312 and the second drum cover 313 are formed in a disk shape having a diameter substantially integral with a diameter of the porous drum 311, and close both open ends of the porous drum 311 and simultaneously supports the porous drum 311. In the center of the second drum cover 313, the connection hole 313*a* for connection with an intake passage 352 of the vacuum-generating member is formed to penetrate, and one end of the hollow shaft 315 is airtightly connected in the connection hole 313*a*. The hollow shaft 315 is installed to extend in an axial direction from the center of an internal space of the porous drum 311, and the other end of the hollow shaft 315 is articulated and supported by the center of the first drum cover 312. A plurality of ventilation holes 316 for sucking air are formed to penetrate a side surface of the hollow shaft 315.

The hollow shaft 315 may function to generate a vacuum pressure by being connected to the vacuum-generating member when performing an anhydrous dyeing process through vacuum transfer, but may also function as a rotating shaft by being connected to a rotating member of a winder when performing a process of winding the yarn T on an outer circumferential surface of the porous drum 311 using the winder before the anhydrous dyeing process starts.

In addition, the plurality of support bars 317 (four in this embodiment) are installed in an axial direction in an internal space of the porous drum 311, and both ends are connected to the first drum cover 312 and the second drum cover 313, respectively, to increase the overall strength and bearing power of the dyeing jig 310. The support bar 317 may be detachably coupled to the first drum cover 312 and the second drum cover 313 by a fastening member such as a bolt 318.

Referring back to FIG. 8, the process chamber 320 has an enclosure form having a space into which the dyeing jig 310 installed with the yarn T and the transfer sheet 20 is put. Although not illustrated in the drawings, an entrance for putting or withdrawing the dyeing jig 310 and a door for opening and closing the entrance are installed at a front face of the process chamber 320, and the door has a transparent heat-resistant window so that the inside may be visually observed.

The dyeing jig 310 put into the process chamber 320 is heated by the heating member during a dyeing process. The heating member expands the space between the molecular structures of the yarn T wound on the dyeing jig 310 so that the dye ink of the transfer sheet 20 may easily permeate into the yarn T. In this embodiment, the heating member includes: an electric heater 341 installed on one side of the process chamber 320 to generate heat by the power source applied from the outside; and a hot air supply blower 342 which supplies external air to the inside of the process chamber 320 after passing through the electric heater 341.

In addition to this hot air supply method, various types of heaters, such as a radiant heat heating type heater capable of heating the yarn T of the dyeing jig 310 by radiant heat, may be applied as the heating member.

In addition, when the anhydrous dyeing process is performed by putting the dyeing jig 310 into the process chamber 320 and generating a vacuum pressure, it may take a lot of time to create a high-temperature environment inside the process chamber 320 by the heating member. Accordingly, in order to perform the anhydrous dyeing process more quickly and effectively, it is preferable to apply the preheating member 360 for preheating by directly delivering heat to the dyeing jig 310.

In this embodiment, the preheating member 360 includes: a preheater 361 spirally wound while extending toward the dyeing jig 310 at a lower portion of the process chamber 320; and a heat transfer member 362 made of a thermally conductive metal which delivers the heat of the preheater 361 to the second drum cover 313 while being articulated to the second drum cover 313 installed on a lower surface of the dyeing jig 310 at the end of the preheater 361.

The heat transfer member 362 has a ring form with a flat upper surface to stably support the second drum cover 313 and have a wide contact area with the second drum cover 313.

The vacuum-generating member applies an external force so that the dye ink particles of the transfer sheet 20 may smoothly permeate into the molecular space of the yarn T in a state in which the space between the molecular structures of the yarn T is expanded by the heating member and the preheating member 360 to be dyed. In this embodiment, the vacuum-generating member includes a vacuum pump 351 installed outside the process chamber 320 to generate a suction force, and the intake passage 352 penetrating a surface of the process chamber 320 and being connected to the dyeing jig 310 to deliver the suction force.

The anhydrous dyeing system with this configuration operates as follows.

First, the transfer sheet 20 to be printed is wound on the loading shaft 161 of the transfer printer 100, and a front end of the transfer sheet 20 is passed between the sheet guide 120 and the nozzle head 130, and then is connected to the sheet transport shaft 251 installed on a front side of the applicator body 210. Subsequently, the mark generator 171 of the position detection unit displays the indexing mark 25 on one side edge point of the transfer sheet 20, and the mark sensor 172 senses the indexing mark 25.

Then, when the operation is started, the sheet transport shaft 251 rotates by a predetermined amount to transport the transfer sheet 20 forward at a predetermined pitch. In this connection, the loading shaft 161 unwinds the transfer sheet 20 while rotating in a direction corresponding to the transport direction of the transfer sheet 20, that is, in a forward direction. Then, while the nozzle head 130 horizontally reciprocates from an upper side of the transfer sheet 20 in a lateral direction, it sprays dye ink on the printed surface of the transfer sheet 20 in a predetermined pattern to apply the ink layers 22.

When the ink layers 22 are printed in a predetermined pattern on the printed surface of the transfer sheet 20, the controller 190 applies a control signal to the servomotor of the return drive portion 162 to operate the return drive portion 162 to rotate the loading shaft 161 in a reverse direction. Accordingly, while the transfer sheet 20 is wound on the loading shaft 161 again, the transfer sheet 20 moves backward.

When the mark sensor 172 of the position detection unit senses the indexing mark 25 while the transfer sheet 20 moves backward, the controller 190 stops the movement of the transfer sheet backward by stopping the operation of the return drive portion 162. Accordingly, the transfer sheet 20 accurately returns to the initial position of the printing operation.

When the transfer sheet 20 returns to the initial position, the transfer sheet 20 is rotated again to advance the transfer sheet 20, and a printing operation of printing dye ink is performed. Then, while the operation of returning the transfer sheet 20 to the initial position is continuously and repeatedly performed again, the ink layers 22 are repeatedly laminated on the printed surface of the transfer sheet 20 a predetermined number of times.

As such, dye ink is repeatedly sprayed on a surface of the transfer sheet 20 a predetermined number of times to laminate and apply the ink layers 22 in a predetermined pattern, and then the transfer sheet 20 is advanced to enter the applied portion of the ink layers 22 into the applicator body 210 of the fine powder applicator 200.

Then, the inorganic fine powder 23 is sprayed onto the transfer sheet 20 from the fine powder supply unit 220 to apply the inorganic fine powder 23 to the ink layers 22. The inorganic fine powder 23 applied to the ink layers 22 absorbs liquid components remaining in the ink layers 22 and dries the same quickly. In this connection, the inorganic fine powder 23 is also smeared on the portion where the ink layers 22 are not formed. However, in the process of passing the portion where the inorganic fine powder 23 is smeared through the fine powder removal unit 230, the inorganic fine powder 23 smeared on the outside of the ink layers 22 is separated and removed from the surface of the transfer sheet 20 by the air blown from the fine powder removal unit 230.

The transfer sheet 20 passing through the fine powder removal unit 230 is heated while sequentially passing through the lower heater 241 and the upper heater 242 of the heating and drying unit, so that the ink layers 22 are completely dried.

The dried transfer sheet 20 is wound on the sheet transport shaft 251 on a front side of the applicator body 210 and then cut into a size that may be wound on the dyeing jig 310 in the vacuum transfer device 300 thereafter.

Separately from the process of manufacturing the transfer sheet 20 using the transfer printer 100 and the fine powder applicator 200 as described above, a process of winding the yarn T on an outer circumferential surface of the dyeing jig 310 by mounting the dyeing jig 310 to the winder proceeds. In this connection, as described above, the yarn T may be continuously wound in a substantially straight line on the outer circumferential surface of the porous drum 311 of the dyeing jig 310. However, it is preferable to wind the yarn T while crossing each other in a zigzag form so that the suction force is smoothly delivered to the transfer sheet 20 through the gaps between the yarns T.

When all of the yarns T are wound on an outer surface of the porous drum 311, the outer surface of the yarns T is covered with the transfer sheet 20 applied with dye ink. In this connection, the surface on which the ink layers 22 of the dye ink is applied comes into contact with the yarn T. In addition, both ends and/or the entire surface of the transfer sheet 20 are covered with the sealing sheet 330 (see FIG. 9) to hermetically seal both ends and/or the entire surface of the transfer sheet 20 with respect to the porous drum 311.

Figure 8:
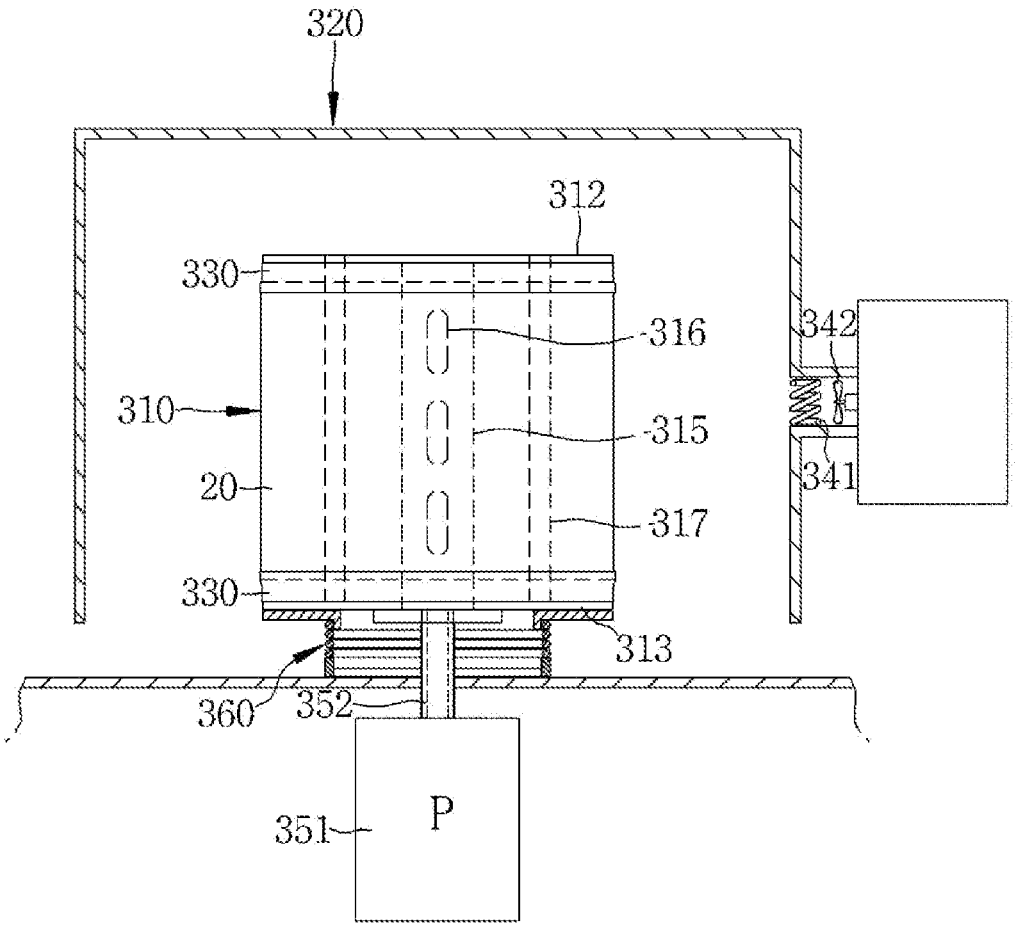
FIG. 8 is a cross-sectional view of an embodiment of a vacuum transfer device of an anhydrous dyeing system according to an embodiment of the present disclosure.
Figure 9:
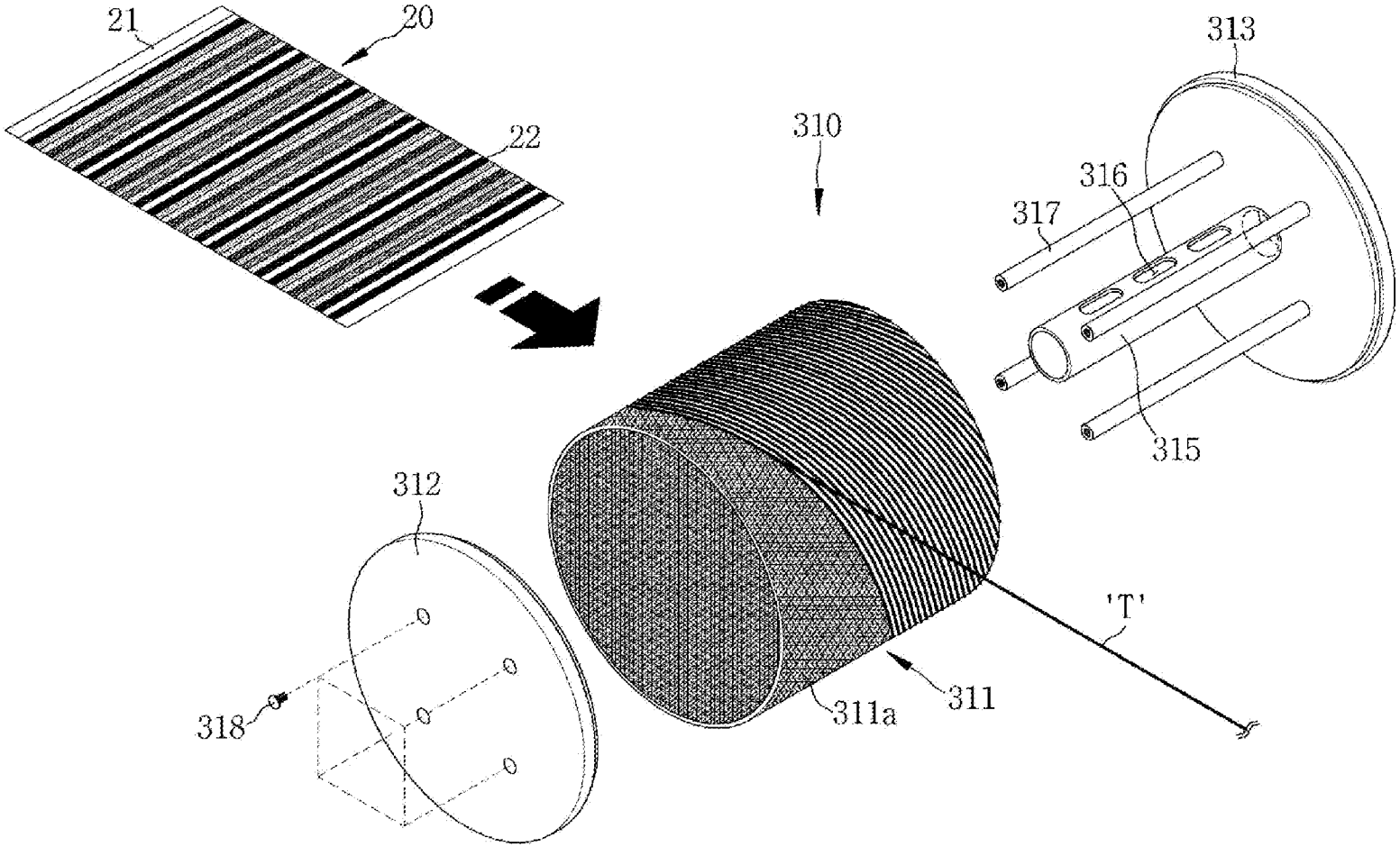
FIG. 9 is an exploded perspective view of the vacuum transfer device illustrated in FIG. 8.
Figure 10:
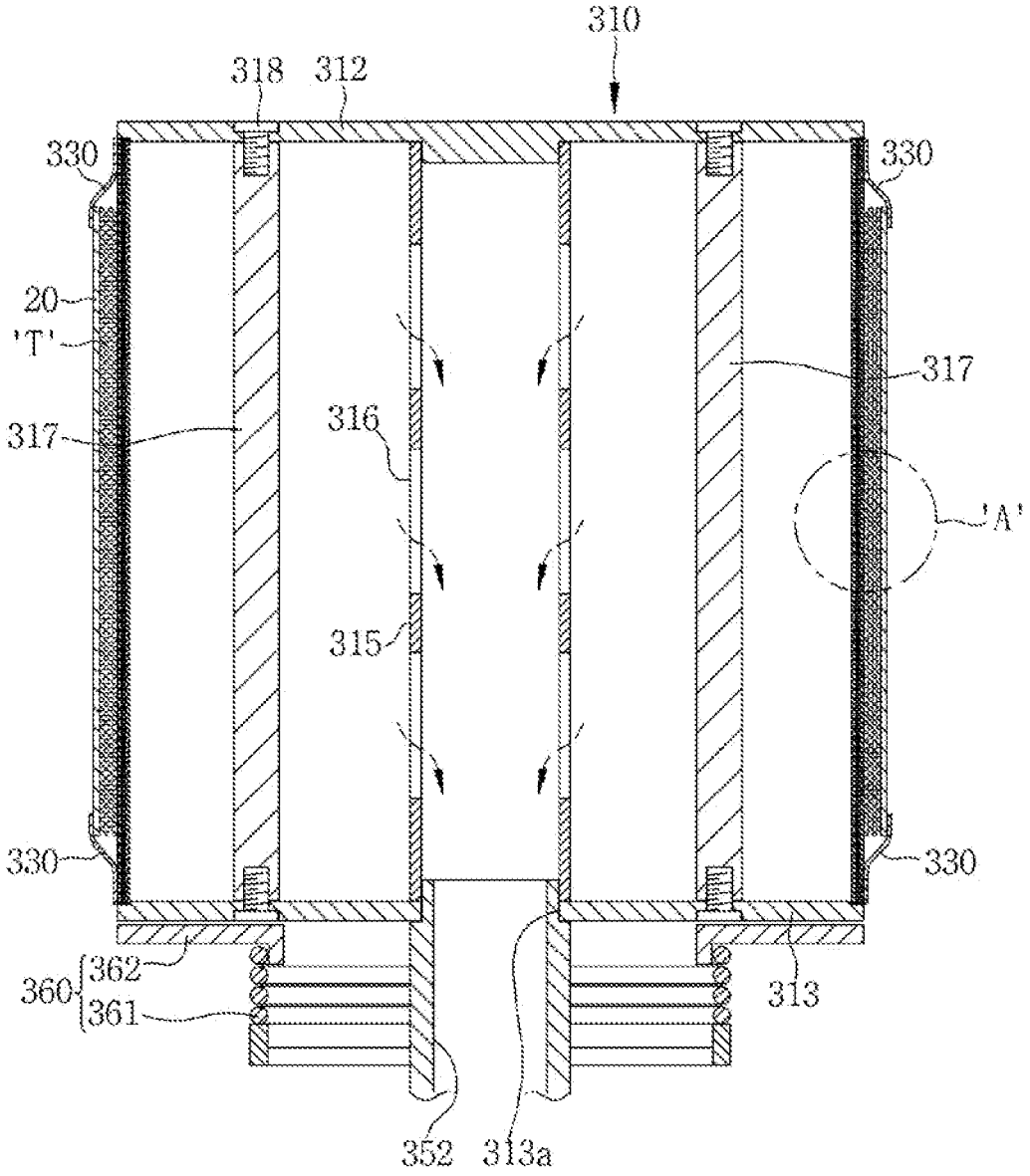
FIG. 10 is a cross-sectional view of a main part of the vacuum transfer device illustrated in FIG. 8.

Then, as illustrated in FIG. 8, the dyeing jig 310 mounted with the yarn T, the transfer sheet 20, and the sealing sheet 330 is put into the process chamber 320, and the dyeing process is prepared by connecting the intake passage 352 to one end of the hollow shaft 315 through the connection hole 313*a* of the second drum cover 12 of the dyeing jig 310.

When this dyeing preparation process is completed, the yarn T is preheated by operating the preheater 61 of the preheating member 360 to deliver heat to the dyeing jig 310. Then, the electric heater 341 and the hot air supply blower 342 are operated to supply hot air to the inside of the process chamber 320.

As such, when the yarn T is heated, the space between the molecular structures of the yarn T expands, making it easy for the dye ink particles to permeate.

In this connection, when the vacuum pump 351 operates, the air inside the porous drum 311 is sucked into the vacuum pump 351 through the ventilation hole 316 of the hollow shaft 315 and the intake passage 352 and a vacuum pressure is formed in the internal space of the dyeing jig 310, and a strong suction force acts through the microholes of the porous drum 311. Accordingly, the dye ink of the transfer sheet 20 is easily transferred into the space between the molecular structures of the expanded yarn T, thereby uniformly dyeing from the outer yarns T wound on the porous drum 311 to the inner yarns T.

As described above, the anhydrous dyeing system of an embodiment of the present disclosure enables, to be performed quickly and efficiently, a series of processes of spraying dye ink on a surface of the transfer sheet 20 in the transfer printer 100 to form the ink layers 22 in a predetermined pattern to manufacture the transfer sheet 20, installing the manufactured transfer sheet 20 by winding the same on an outer surface of the yarn T wound on an outer circumferential surface of the dyeing jig 310, and then heating the yarn T in the process chamber 320 and forming the vacuum pressure in the dyeing jig 310 to dye the dye ink of the transfer sheet 20 on the yarn T by a vacuum transfer method.

In particular, after ink layers 22 are repeatedly printed and laminated on the transfer sheet in the transfer printer 100 a plurality of times, the inorganic fine powder 23 is supplied to the ink layers 22 in the fine powder applicator 200 so that the ink layers 22 can be quickly dried, thereby preventing defects in the transfer sheet 20 due to smearing of the ink layers 22 after application of the ink layers 22.

In addition, since the transfer printer 100 can accurately return the transfer sheet 20 to its initial position using a position detection unit and repeatedly laminate and apply the ink layers 22, a sufficient amount of dye ink required for anhydrous dyeing of yarn can be quickly and easily applied to the transfer sheet 20 in an accurate pattern.

In the vacuum transfer device 300, the yarn T is wound on the cylindrical porous drum 311, and a vacuum pressure is formed inside the porous drum 311, so that the dye ink applied to the transfer sheet 20 is transferred to the yarn T and dyed. Hence, it is possible to very quickly and easily perform a dyeing process without using liquid. Furthermore, there is no need to purify the liquid for dyeing, thereby improving economic feasibility and eco-friendliness.

In addition, when the porous drum 311 of the dyeing jig 310 is configured by laminating the plurality of mesh plates 311*a* in which microholes are formed, the vacuum pressure is uniformly formed over the entire surface of the porous drum 311 to dye the yarn so that the yarn can be dyed in a desired pattern.

Hereinabove, the present disclosure has been described in detail with reference to the embodiments, but those of ordinary skill in the art to which the present disclosure pertains may perform various substitutions, additions, and modifications without departing from the technical idea described above. It should be understood that such modified embodiments also fall within the scope of protection of the present disclosure as defined by the appended claims below.

An embodiment of the present disclosure may be applied to a yarn dyeing device for dyeing yarn (fiber) of fabrics or knitted fabrics used for clothing, shoes, fashion accessories, and the like.

The invention claimed is:

1. An anhydrous dyeing system for yarn, the system including:

a transfer printer which repeatedly sprays dye ink on a surface of a transfer sheet a plurality of times to laminate and apply ink layers;

a dyeing jig which is in a drum form having a plurality of microholes formed in an outer circumferential surface thereof to penetrate inside and outside, wherein the yarn to be dyed and the transfer sheet on which the ink layers are applied are sequentially wound on the outer circumferential surface thereof;

a process chamber into which the dyeing jig is put;

a heating member for heating the yarn wound on the dyeing jig, by supplying heat to the inside of the process chamber;

a vacuum-generating member which is in communication with an internal space of the dyeing jig and vacuum-evacuates the air in the internal space of the dyeing jig to thereby form a vacuum pressure inside the dyeing jig; and a fine powder applicator which applies and dries inorganic fine powder to the ink layers of the transfer sheet while transporting the transfer sheet on which the ink layers are applied in one direction and passing through the transfer printer.

2. The system of claim 1, wherein the fine powder applicator includes:

an applicator body disposed in a row in front of the transfer printer;

a fine powder supply unit disposed on an upper side of a transport path of the transfer sheet and spraying the inorganic fine powder to a lower side;

a fine powder removal unit disposed on a front side of the fine powder supply unit and spraying air toward the transfer sheet to separate and remove the inorganic fine powder smeared on an outside of the ink layers from a surface of the transfer sheet; and a heating and drying unit installed on a front side of the fine powder removal unit and applying heat toward the transfer sheet.

3. The system of claim 2, wherein the heating and drying unit includes: a lower heater disposed on a lower side of the transport path of the transfer sheet to apply heat to the transfer sheet; and an upper heater disposed on a front side of the lower heater and disposed on an upper side of the transport path of the transfer sheet to apply heat to the transfer sheet.

4. The system of claim 1, wherein the dyeing jig includes:

a porous drum having the plurality of microholes formed to penetrate inside and outside;

a first drum cover which closes an opening on one side of the porous drum;

a second drum cover which closes an opening on the other side of the porous drum;

a hollow shaft installed to extend in an axial direction inside the porous drum and having both ends connected to the first drum cover and the second drum cover, having one end connected to the vacuum-generating member through the center of the second drum cover, and having a plurality of ventilation holes formed to penetrate a side surface.

5. The system of claim 4, wherein the porous drum is made into a cylindrical shape after a plurality of mesh plates having microholes formed therein are laminated.

6. The system of claim 4, further including a preheating member installed to contact a surface of the dyeing jig to deliver heat to the yarn through the surface of the dyeing jig.

7. The system of claim 6, wherein the preheating member includes:

a preheater spirally wound while extending toward the dyeing jig at a lower portion or an upper portion of the process chamber; and a heat transfer member made of a thermally conductive metal which is installed at the end of the preheater to contact a lower surface or an upper surface of the dyeing jig and deliver heat of the preheater to the dyeing jig.

8. An anhydrous dyeing system for yarn, the system including;

a transfer printer which repeatedly sprays dye ink on a surface of a transfer sheet a plurality of times to laminate and apply ink layers;

a dyeing jig which is in a drum form having a plurality of microholes formed in an outer circumferential surface thereof to penetrate inside and outside, wherein the yarn to be dyed and the transfer sheet on which the ink layers are applied are sequentially wound on the outer circumferential surface thereof;

a process chamber into which the dyeing jig is put;

a heating member for heating the yarn wound on the dyeing jig, by supplying heat to the inside of the process chamber; and a vacuum-generating member which is in communication with an internal space of the dyeing jig and vacuum-evacuates the air in the internal space of the dyeing jig to thereby form a vacuum pressure inside the dyeing jig, wherein the transfer printer includes:

a printer body;

a loading shaft rotatably installed at a rear of the printer body to wind the transfer sheet to be printed;

a sheet guide guided while the transfer sheet, which is released from the loading shaft, passes;

a nozzle head installed on an upper side of the sheet guide to be reciprocally movable in a lateral direction and spraying the dye ink in a predetermined pattern on a printed surface of the transfer sheet to apply the ink layers;

an ink supply portion for supplying the dye ink to the nozzle head;

a return drive portion which moves the transfer sheet backward by rotating the loading shaft in a reverse direction; and a position detection unit which detects a position of the transfer sheet when the transfer sheet moves backward and returns by the return drive portion, wherein the position detection unit includes: a mark generator installed in the printer body to generate an indexing mark on the printed surface of the transfer sheet immediately before starting a print job; and a mark sensor installed on one side of the mark generator to sense the indexing mark.

* * * * *